US009915273B2

(12) United States Patent
Katsumata et al.

(10) Patent No.: US 9,915,273 B2
(45) Date of Patent: Mar. 13, 2018

(54) BLOWER DEVICE

(71) Applicant: Panasonic Intellectual Property Management Co., Ltd., Osaka (JP)

(72) Inventors: Shinsuke Katsumata, Aichi (JP); Ippei Oda, Aichi (JP); Takashi Fujisono, Aichi (JP)

(73) Assignee: PANASONIC INTELLECTUAL PROPERTY MANAGEMENT CO., LTD., Okaka (JP)

( * ) Notice: Subject to any disclaimer, the term of this patent is extended or adjusted under 35 U.S.C. 154(b) by 229 days.

(21) Appl. No.: 14/775,674

(22) PCT Filed: Feb. 6, 2014

(86) PCT No.: PCT/JP2014/000623
§ 371 (c)(1),
(2) Date: Sep. 12, 2015

(87) PCT Pub. No.: WO2014/147942
PCT Pub. Date: Sep. 25, 2014

(65) Prior Publication Data

US 2016/0025109 A1 Jan. 28, 2016

(30) Foreign Application Priority Data

Mar. 19, 2013 (JP) ..... 2013-056353

(51) Int. Cl.
*F04D 29/66* (2006.01)
*F04D 29/42* (2006.01)
(Continued)

(52) U.S. Cl.
CPC ..... *F04D 29/665* (2013.01); *F04D 17/08* (2013.01); *F04D 29/162* (2013.01);
(Continued)

(58) Field of Classification Search
CPC .... F04D 29/162; F04D 29/281; F04D 29/403; F04D 29/663; F04D 29/326; F04D 29/54;
(Continued)

(56) References Cited

U.S. PATENT DOCUMENTS 8,123,468 B2 * 2/2012 Shirahama ..... F04D 29/664 415/119
9,441,642 B2 * 9/2016 Rao ..... F04D 29/162
(Continued)

FOREIGN PATENT DOCUMENTS

JP 60-209699 10/1985
JP 5-280497 10/1993
(Continued)

OTHER PUBLICATIONS

International Search Report of PCT application No. PCT/JP2014/000623 dated Apr. 28, 2014.

*Primary Examiner* — Igor Kershteyn
*Assistant Examiner* — Brian P Wolcott
(74) *Attorney, Agent, or Firm* — Pearne & Gordon LLP

(57) ABSTRACT

A blower includes: centrifugal impeller disposed in inside of casing; and motor which is configured to drive centrifugal impeller. Annular projecting portion which projects in a direction toward the outside of the casing and is concentric with centrifugal impeller is provided around inflow port of casing which faces a fixing-member of centrifugal impeller. Projecting portion includes: raised wall which is raised so as to be away from centrifugal impeller parallel to a direction of the rotary shaft; and flat portion formed in an extending manner in a direction toward inflow port from raised wall. Projecting portion further includes inflow wall which falls toward the centrifugal impeller from an end surface of flat portion toward an inflow port. Flat portion is parallel to an upper end surface of centrifugal impeller.

6 Claims, 6 Drawing Sheets

(51) Int. Cl.
*F04D 29/28* (2006.01)
*F04D 29/16* (2006.01)
*F04D 17/08* (2006.01)

(52) U.S. Cl.
CPC ..... *F04D 29/281* (2013.01); *F04D 29/4206* (2013.01); *F04D 29/4213* (2013.01); *F04D 29/4226* (2013.01)

(58) Field of Classification Search
CPC .... F04D 29/541; F04D 29/545; F04D 29/547; F04D 29/665; F04D 29/4026; F04D 29/4213; F04D 29/4226
See application file for complete search history.

(56) References Cited

U.S. PATENT DOCUMENTS

| | | | | |
|---|---|---|---|---|
| 2007/0041831 | A1* | 2/2007 | Bartlett | F04D 29/663 415/206 |
| 2011/0002775 | A1* | 1/2011 | Ma | F04D 29/664 415/119 |

FOREIGN PATENT DOCUMENTS

| | | | |
|---|---|---|---|
| JP | 5-340394 | | 12/1993 |
| JP | 2009-092009 | A | 4/2009 |
| JP | 2010-014043 | A | 1/2010 |
| JP | 2012-036827 | | 2/2012 |
| JP | 2012-140881 | | 7/2012 |

* cited by examiner

BLOWER DEVICE

TECHNICAL FIELD

The present invention relates to a blower used in a ceiling-embedded type ventilation fan or the like.

BACKGROUND ART

Conventionally, as a blower of this type, there has been known a blower in which an orifice having a bellmouth-shaped inflow port is formed (see PTL 1, for example).

Hereinafter, the conventional blower is described with reference to FIG. 6.

As shown in FIG. 6, in centrifugal multi-blade fan 102 of multi-blade blower 101, a plurality of blades 108 are annularly formed on a portion of bottom plate 107 in the vicinity of an outer peripheral edge of bottom plate 107 in the circumferential direction. Annular holder ring 109 is formed on top portions of blades 108 on a side opposite to bottom plate 107. Ceiling portion 105 of casing 104 which houses centrifugal multi-blade fan 102 is positioned higher than a top portion of centrifugal multi-blade fan 102, and bellmouth 110 which is raised from ceiling portion 105 is formed. Bellmouth 110 is bent in a semi-arcuate shape, and an inner diameter end of bellmouth 110 extends downwardly to an area in the vicinity of the top portion of centrifugal multi-blade fan 102. Bellmouth 110 is provided for preventing the generation of a reverse flow of air toward an inner diameter, the air passing a minute gap formed between lower end 106 of the bellmouth and fan top portion 103 through an area in the vicinity of ceiling portion 105 of casing 104 from an outer periphery of centrifugal multi-blade fan 102 which is a blow-out port of blades 108.

CITATION LIST

Patent Literature

PTL 1: Unexamined Japanese Patent Publication No. 5-280497

SUMMARY OF THE INVENTION

Such a conventional blower has a drawback that a space in the vicinity of the inflow port is not effectively used as a silencing space.

In view of the above, it is an object of the present invention to provide a blower where a noise is suppressed by effectively making use of an interference of sound waves in a space in the vicinity of an inflow port.

In the present invention, a blower includes: a casing having an inflow port and an outflow port; a centrifugal impeller disposed in inside of the casing; and a motor which is configured to drive the centrifugal impeller. The centrifugal impeller includes: a main plate fixed to a rotary shaft of the motor; a plurality of blades annularly disposed on an outer periphery of the main plate; and a ring-shaped fixing member which fixes the blades together on outer peripheries of the blades on a side opposite to the main plate. An annular projecting portion which projects in a direction toward the outside of the casing and is concentric with the centrifugal impeller is provided around the inflow port of the casing which faces a fixing-member of the centrifugal impeller. The projecting portion includes a raised wall which is raised so as to be away from the centrifugal impeller parallel to a direction of the rotary shaft, a flat portion formed in an extending manner in a direction toward the inflow port from the raised wall, and an inflow wall which falls toward the centrifugal impeller from an end surface of the flat portion toward an inflow port. The flat portion is parallel to an upper end surface of the centrifugal impeller.

According to the present invention, the projecting portion formed by the raised wall, the flat portion and the inflow wall forms an annular recess in the inside of the casing. A part of sound waves generated from a sound source enters a silencing space formed by the recess from a silencing space entrance surface which is a boundary between the silencing space and a main flow passage, is reflected on the flat portion, and returns to the silencing space entrance surface again. In this case, between sound waves which are transmitted through the silencing space and sound waves which are not transmitted through the silencing space, a path difference of sound waves which corresponds to a going and returning distance between the silencing space entrance surface and the flat portion in a direction of the rotary shaft of the motor is generated. The silencing space entrance surface is parallel to the flat portion, and hence the path difference is constant in the silencing space. Sound waves from the sound source in the main flow passage having a frequency where the path difference corresponds to a ½ wavelength are synthesized with the sound waves transmitted through the silencing space with the phases opposite to each other so that the sounds are silenced. Accordingly, a noise transmitted mainly from the inside of the duct connected to the outflow port can be suppressed.

DESCRIPTION OF EMBODIMENTS

Hereinafter, exemplary embodiments of the present invention are described with reference to drawings.

First Exemplary Embodiment

Figure 1:
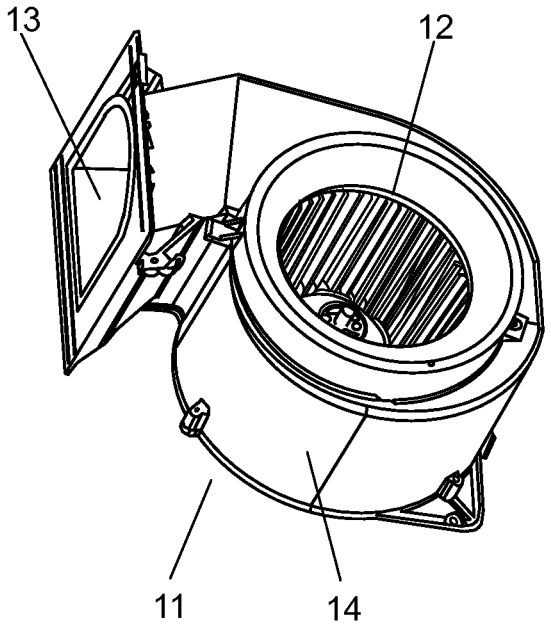
FIG. 1 is a perspective view showing a blower of a first exemplary embodiment of the present invention.
Figure 2:
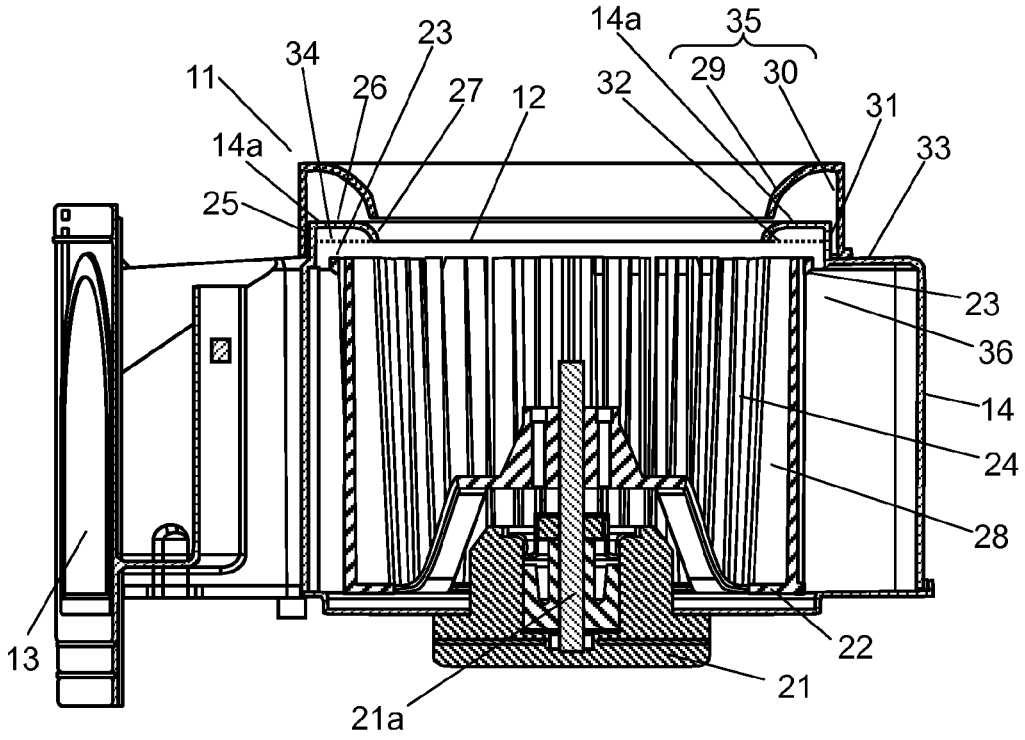
FIG. 2 is a constitutional view showing a cross section of the blower of the first exemplary embodiment of the present invention.
Figure 3:
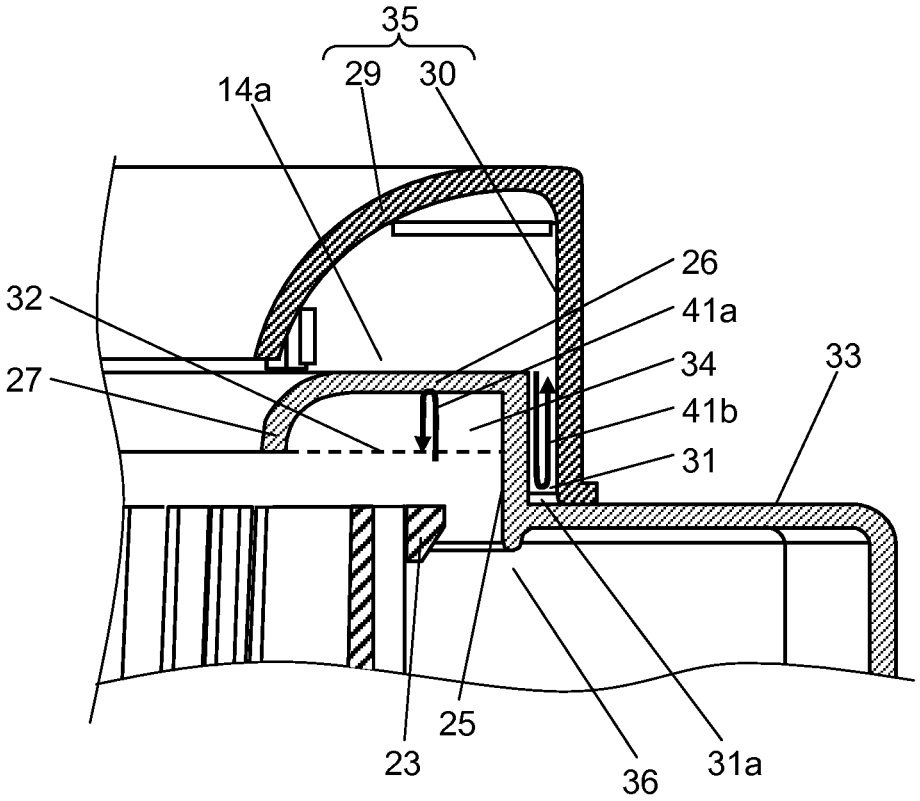
FIG. 3 is an enlarged view of an essential part in FIG. 2 showing a cross section of the blower of the first exemplary embodiment of the present invention at a position in the vicinity of an inflow port.

FIG. 1 is a perspective view of blower 11 of a first exemplary embodiment of the present invention. FIG. 2 is a constitutional view showing a cross section of blower 11 of the first exemplary embodiment of the present invention. FIG. 3 is an enlarged view of an essential part in FIG. 2 of blower 11 of the first exemplary embodiment of the present invention at a position in the vicinity of inflow port 12.

As shown in FIG. 1 and FIG. 2, blower 11 includes: casing 14 having inflow port 12 and outflow port 13; centrifugal impeller 24 disposed in the inside of casing 14; and motor 21 which is configured to drive centrifugal impeller 24. Centrifugal impeller 24 includes: main plate 22 fixed to rotary shaft 21*a* of motor 21; a plurality of blades 28 annularly disposed on an outer periphery of main plate 22; and ring-shaped fixing member 23 which fixes blades 28 together on outer peripheries of blades 28 on a side opposite to main plate 22.

Annular projecting portion 14*a* which projects in a direction toward the outside of casing 14 and is concentric with centrifugal impeller 24 is disposed around inflow port 12 of casing 14 which faces a fixing-member-23 side of centrifugal impeller 24. Projecting portion 14*a* includes raised wall 25 which is raised so as to be away from centrifugal impeller 24 parallel to an axial direction of rotary shaft 21*a* and flat portion 26 formed in an extending manner in a direction toward inflow port 12 from raised wall 25 parallel to an upper end surface of centrifugal impeller 24. Projecting portion 14*a* further includes inflow wall 27 which falls toward a centrifugal-impeller-24 from an end surface of flat portion 26 on an inflow port 12.

With such a configuration, as shown in FIG. 3, silencing space 34 is formed in the inside of casing 14 in a form of an annular recess by raised wall 25, flat portion 26 and inflow wall 27 which form projecting portion 14*a*. A part of sound waves generated in the inside of a duct (not shown in the drawing) connected to outflow port 13, that is, a part of turbulence noise generated in the duct or a friction sound generated between the duct and the air flow is transmitted via flat portion 26 from silencing space entrance surface 32 which is a boundary between silencing space 34 and main flow passage 36. Then, the part of sound waves returns to silencing space entrance surface 32 again. However, between sound waves which are transmitted via silencing space 34 and sound waves which are not transmitted via silencing space 34, path difference 41*a* of sound waves which correspond to a going and returning distance between silencing space entrance surface 32 and flat portion 26 in the direction of the rotary shaft of motor 21 is generated.

Silencing space entrance surface 32 of silencing space 34 is parallel to flat portion 26, and hence path difference 41*a* of sound waves is constant in silencing space 34. Accordingly, a noise having a specified frequency which forms a main noise in blower 11 can be set as a silencing target. In addition to the above, by increasing a ratio of a cross sectional area of silencing space 34 to a cross sectional area of main flow passage 36 by enlarging flat portion 26, an amount of silenced sound can be increased. In this manner, in blower 11 of this exemplary embodiment, sound waves from the sound source in main flow passage 36 having a frequency where path difference 41*a* of sound waves corresponds to a ½ wavelength are synthesized with the sound waves transmitted via silencing space 34 with the phases opposite to each other so that the sounds are silenced. A noise transmitted mainly from the inside of the duct connected to outflow port 13 can be suppressed.

At least a flat-portion-26 side of inflow wall 27, that is, a side of inflow wall 27 which is contiguously formed with flat portion 26 is formed of a curved surface projecting toward an inflow-port-12 side, in other words, toward the center of inflow port 12. As shown in FIG. 2 and FIG. 3, inflow wall 27 is formed into a curved surface shape toward centrifugal impeller 24. With such a configuration, the air flow can be made to flow into centrifugal impeller 24 while reducing a pressure loss, and hence an efficiency of blower 11 can be enhanced.

It is not necessary that the whole surface of inflow wall 27 be formed into a curved surface shape. For example, even when a distal end of the surface of inflow wall 27 close to centrifugal impeller 24 has a flat surface shape, a pressure loss can be reduced.

An inner diameter of inflow port 12 is set substantially equal to an inner diameter of centrifugal impeller 24. With such a configuration, the air flow smoothly flows toward blades 28 so that turbulence is minimally generated in the air flow. Accordingly, a noise can be reduced, and at the same time, a blow-out efficiency of blades 28 can be enhanced. When the inner diameter of inflow port 12 is not set equal to the inner diameter of centrifugal impeller 24, the air flow does not smoothly flow into casing 14 along blades 28.

To make inflow-port-side outer wall surface 33 of casing 14 which is contiguously formed with raised wall 25 and an end surface of centrifugal impeller 24 on an inflow port 12 substantially coplanar with each other, raised wall 25 is raised from a position having a diameter larger than an outer diameter of centrifugal impeller 24. With such a configuration, the air flow smoothly flows out from blades 28 so that turbulence is minimally generated in the air flow. Accordingly, a noise can be reduced, and at the same time, a blow-out efficiency of blades 28 can be enhanced.

Silencing orifice 35 having bellmouth-shaped suction port 29 which is concentric with inflow port 12 and orifice outer wall 30 is disposed outside casing 14. Orifice outer wall 30 is disposed parallel to raised wall 25 with a gap formed therebetween so as to surround raised wall 25, and orifice outer wall 30 is connected to inflow-port-side outer wall surface 33 of casing 14 which is contiguously formed with raised wall 25. With such a configuration, path difference 41*b* of sound waves larger than path difference 41*a* of sound waves is newly generated in gap 31 formed between raised wall 25 and silencing orifice 35, and gap 31 has a silencing effect. A ½ wavelength of a noise forming a silencing target which corresponds to path difference 41*b* of sound waves is also increased, and frequency is inversely proportional to a wavelength, and hence a noise having a low frequency can be particularly suppressed.

In gap 31, flat portion 31*a* is short in width so that an amount of silenced sound is decreased. However, gap 31 has a silencing effect with respect to a noise having a specified frequency.

Second Exemplary Embodiment

Next, a blower of a second exemplary embodiment of the present invention is described with reference to FIG. 4 and FIG. 5.

Figure 4:
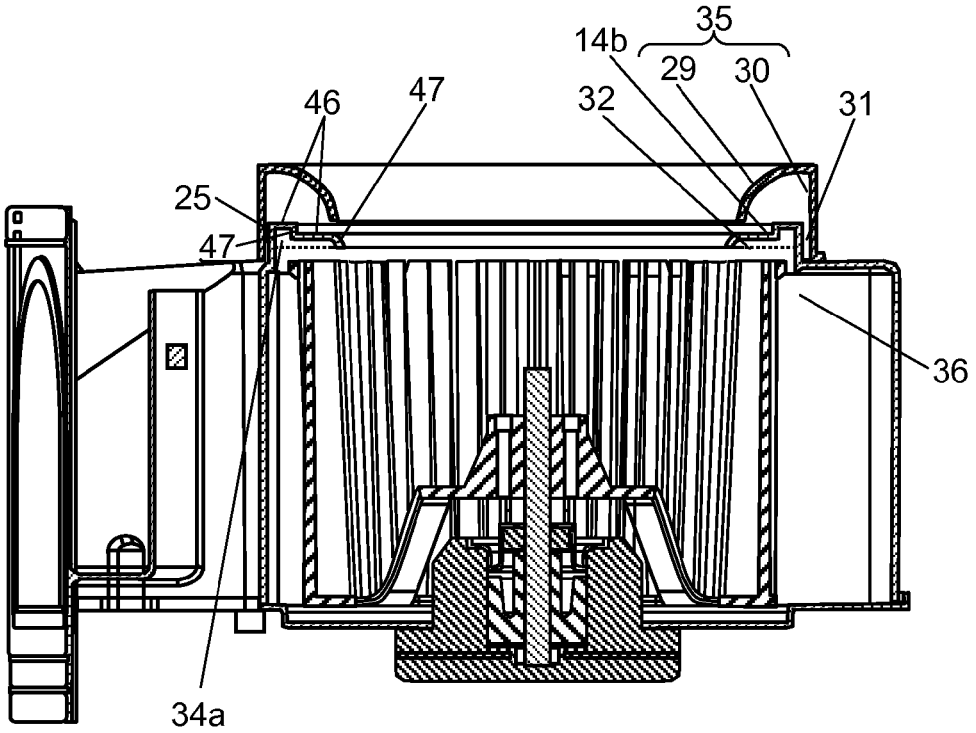
FIG. 4 is a constitutional view showing a cross section of a blower of a second exemplary embodiment of the present invention.
Figure 5:
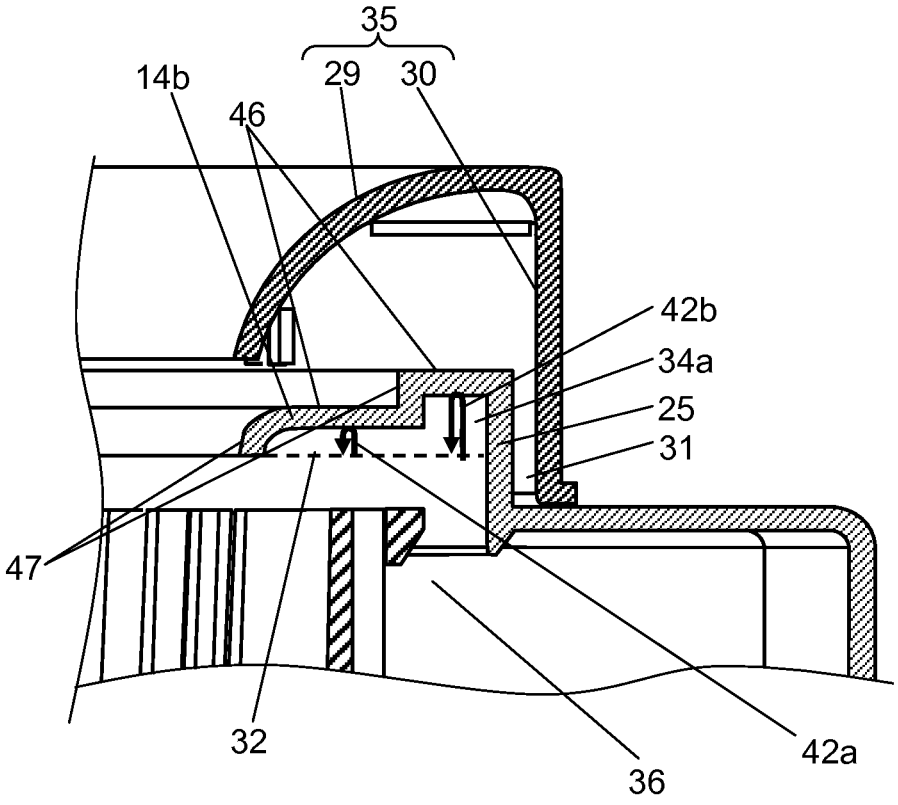
FIG. 5 is an enlarged view of an essential part in FIG. 4 showing a cross section of the blower of the second exemplary embodiment of the present invention at a position in the vicinity of an inflow port.
Figure 6:
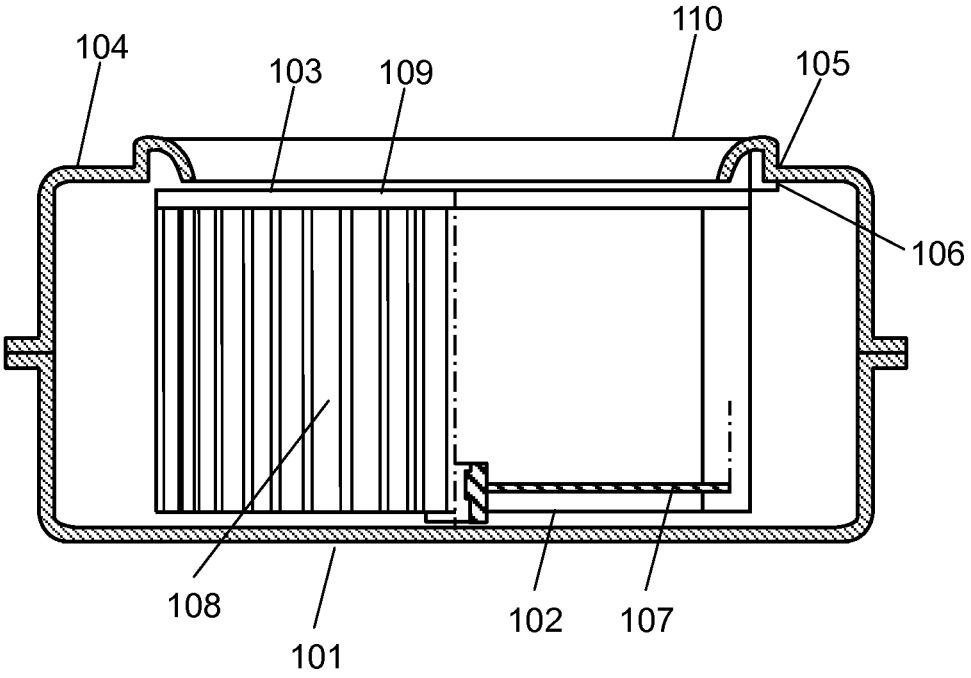
FIG. 6 is a constitutional view showing a cross section of a conventional blower.

In FIG. 4 and FIG. 5, constitutional elements identical to constitutional elements in FIG. 2 and FIG. 3 are given the same symbols and the detailed description of the identical elements is omitted.

As shown in FIG. 4 and FIG. 5, in the blower according to the second exemplary embodiment of the present invention, projecting portion 14*b* includes raised wall 25, a plurality of flat portions 46 and a plurality of inflow walls 47.

With such a configuration, silencing space 34*a* is formed by projecting portion 14*b* in the form of an annular recess, and a plurality of surfaces which are parallel to silencing space entrance surface 32 are formed on projecting portion 14*b*. With such a configuration, for example, in FIG. 5, a plurality of paths each of which corresponds to a going and returning distance between silencing space entrance surface 32 and flat portion 46 are formed. The paths have path differences 42*a*, 42*b* of different sound waves respectively.

Sound waves which are transmitted through the respective paths return to the original silencing space entrance surface 32 with a phase delay of a ½ wavelength. Accordingly, in this exemplary embodiment, due to the silencing principle similar to the silencing principle of the blower of the first exemplary embodiment of the present invention, the sound waves which are transmitted through the respective paths are synthesized with a plurality of sound waves from a sound source in main flow passage 36 with the phases opposite to each other so that the sounds are silenced. In this manner, according to the blower of this exemplary embodiment, the noise which can be silenced can be increased to a plurality of noises having different frequencies. In this exemplary embodiment, the flat portion includes two flat portions 46 and the inflow wall includes two inflow walls 47. However, the number and disposition of flat portions 46 and inflow walls 47 may be set arbitrarily.

As has been described above, the blower of the present invention is configured as follows. That is, the blower includes: the casing having the inflow port and the outflow port; the centrifugal impeller disposed in the inside of the casing; and the motor configured to drive the centrifugal impeller. The centrifugal impeller includes: the main plate fixed to the rotary shaft of the motor; the plurality of blades annularly disposed on the outer periphery of the main plate; and the ring-shaped fixing member which fixes the blades together on outer peripheries of the blades on a side opposite to the main plate. The annular projecting portion which projects in a direction toward the outside of the casing and is concentric with the centrifugal impeller is provided around the inflow port of the casing which faces the fixing-member side of the centrifugal impeller. The projecting portion includes the raised wall which is raised so as to be away from the centrifugal impeller parallel to the direction of the rotary shaft, the flat portion formed in an extending manner in the direction toward the inflow port from the raised wall, and the inflow wall which falls toward the centrifugal impeller side from the end surface of the flat portion toward an inflow port. Further, the flat portion is parallel to the end surface of the centrifugal impeller on a fixing member side.

With such a configuration, the projecting portion formed by the raised wall, the flat portion and the inflow wall forms an annular recess in the inside of the casing as the silencing space. A part of sound waves generated from a sound source enters the silencing space formed by the recess from a boundary between the silencing space and a main flow passage, is reflected on the flat portion, and returns to the silencing space entrance surface again. In this case, between sound waves which are transmitted through the silencing space and sound waves which are not transmitted through the silencing space, a path difference of sound waves which corresponds to a going and returning distance between the silencing space entrance surface and the flat portion in a direction of the rotary shaft of the motor is generated. The silencing space entrance surface is parallel to the flat portion, and hence the path difference is constant in the silencing space. Sound waves from the sound source in the main flow passage having a frequency where the path difference corresponds to a ½ wavelength are synthesized with the sound waves transmitted through the silencing space with the phases opposite to each other so that the sounds are silenced. Accordingly, a noise transmitted mainly from the inside of the duct connected to the outflow port can be suppressed.

The flat portion may be formed of a plurality of flat portions and the inflow wall may be formed of a plurality of inflow walls. Due to the above-mentioned silencing principle, by forming a plurality of surfaces which are parallel to the silencing space entrance surface, a plurality of path differences of sound waves having different lengths are generated where each path difference corresponds to a going and returning distance between the silencing space entrance surface and the flat portion. The sound waves having different frequencies from a sound source in the main flow passage are synthesized in a state where the sound waves have phases opposite to each other so that the sounds are silenced. Accordingly, the number of noises having different frequencies which can be silenced can be increased.

At least a side of the inflow wall which is contiguously formed with the flat portion may be formed of a curved surface projecting toward an inflow port side, in other words, toward the center of the inflow port. With such a configuration, the air flow can be made to flow into the centrifugal impeller while reducing a pressure loss, and hence an efficiency of the blower can be enhanced.

An inner diameter of the inflow port may be substantially equal to an inner diameter of the centrifugal impeller. With such a configuration, the air flow which enters through the inflow port smoothly flows toward the blades so that turbulence is minimally generated in the air flow, and hence a noise can be reduced, and at the same time, a blow-out efficiency of the blower can be enhanced.

The raised wall may be raised from a position outside the centrifugal impeller, and the inflow-port-side outer wall surface of the casing which is contiguously formed with the raised wall and the end surface of the centrifugal impeller on an inflow port may be made substantially coplanar with each other. With such a configuration, the air flow smoothly flows out from the blades so that turbulence is minimally generated in the air flow, and hence a noise can be reduced, and at the same time, a blow-out efficiency of the blower can be enhanced.

The silencing orifice having the bellmouth-shaped suction port which is concentric with the inflow port and the orifice outer wall are provided outside the casing. The orifice outer wall is disposed parallel to the raised wall with a gap formed therebetween so as to surround the raised wall, and the orifice outer wall is connected to the inflow-port-side outer wall surface of the casing which is contiguously formed with the raised wall. With such a configuration, a path difference of sound waves is newly formed in a gap formed between the raised wall and the silencing orifice so that the gap has a silencing effect. A path difference of sound waves which corresponds to a ½ wavelength of a noise forming a silencing target can be increased, and hence a noise having a low frequency can be suppressed.

INDUSTRIAL APPLICABILITY

The blower of the present invention can reduce a noise of a centrifugal blower, and hence the blower of the present invention is useful as a blower used in a ventilation blower, air conditioning equipment or the like.

REFERENCE MARKS IN THE DRAWINGS

11 blower
12 inflow port
13 outflow port
14 casing
14*a*, 14*b* projecting portion
21 motor
21*a* rotary shaft
22 main plate

23 fixing member
24 centrifugal impeller
25 raised wall
26, 31*a*, 46: flat portion
27, 47 inflow wall
28 blade
29 suction port
30 orifice outer wall
31 gap
32 silencing space entrance surface
33 inflow-port-side outer wall surface
34, 34*a*: silencing space
35 silencing orifice
36 main flow passage
41*a* path difference of sound waves
41*b* path difference of sound wave
42*a* path difference of sound wave
42*b* path difference of sound wave
101 multi-blade blower
102 centrifugal multi-blade fan
103 fan top portion
104 casing
105 ceiling portion
106 bellmouth lower end
107 bottom plate
108 blade
109 holder ring
110 bellmouth

The invention claimed is:

1. A blower comprising:

a casing having an inflow port and an outflow port;

a centrifugal impeller disposed inside of the casing; and a motor which is configured to drive the centrifugal impeller, wherein the centrifugal impeller comprises:

a main plate fixed to a rotary shaft of the motor;

a plurality of blades annularly disposed on an outer periphery of the main plate; and a ring-shaped fixing member which fixes the plurality of blades together on outer peripheries of the plurality of blades on a place opposite to the main plate, an annular projecting portion which projects in a direction toward an outside of the casing and is concentric with the centrifugal impeller is provided around a portion of the inflow port facing the ring-shaped fixing member, the annular projecting portion includes a raised wall which is raised so as to be away from the centrifugal impeller parallel to a direction of the rotary shaft, a flat portion formed in an extending manner in a direction toward the inflow port from the raised wall, and an inflow wall which falls toward the centrifugal impeller from an end surface of the flat portion toward the inflow port, the flat portion is parallel to an end surface of the centrifugal impeller on the fixing member, the raised wall has a first end and a second end, the second end is located farther away from the centrifugal impeller than the first end, and the flat portion extends from the second end of the raised wall, and wherein the flat portion includes a plurality of sub-flat portions, and each of the sub-flat portions has a different height from an end surface of the inflow wall in an axial direction of the blower.

2. The blower according to claim 1, wherein the flat portion includes a plurality of flat portions and the inflow wall includes a plurality of inflow walls.

3. The blower according to claim 1, wherein at least a portion of the inflow wall toward the flat portion has a curved surface projecting toward the inflow port.

4. The blower according to claim 1, wherein an inner diameter of the inflow port is substantially equal to an inner diameter of the centrifugal impeller.

5. The blower according to claim 1, wherein the raised wall is raised from a position outside an outer diameter of the centrifugal impeller, and wherein an inflow-port-side outer wall surface of the casing contiguously formed with the raised wall is made substantially coplanar with an end surface of the centrifugal impeller on the inflow port.

6. The blower according to claim 1, wherein a silencing orifice having a bellmouth-shaped suction port which is concentric with the inflow port and an orifice outer wall is provided outside the casing, the orifice outer wall is disposed parallel to the raised wall with a gap formed therebetween so as to surround the raised wall, and the orifice outer wall is connected to an inflow-port-side outer wall surface of the casing which is contiguously formed with the raised wall.

* * * * *